US005970279A

United States Patent [19]

Sakaizawa et al.

[11] Patent Number: 5,970,279

[45] **Date of Patent: *Oct. 19, 1999**

[54] IMAGE FORMING APPARATUS

[75] Inventors: Katsuhiro Sakaizawa, Numazu; Yukihiro Ohzeki, Yokohama, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/089,132

[22] Filed: Jun. 2, 1998

[30] Foreign Application Priority Data

Jun. 2, 1997 [JP] Japan ..... 9-144262

[51] Int. Cl.[6] ..... G03G 15/00

[52] U.S. Cl. ..... 399/46; 399/50; 399/55; 399/149

[58] Field of Search ..... 399/38, 46, 50, 399/53, 55, 66, 149, 150

[56] References Cited

U.S. PATENT DOCUMENTS

| | | | |
|---|---|---|---|
| 4,974,026 | 11/1990 | Maruyama | 399/46 |
| 5,010,370 | 4/1991 | Araya et al. . | |
| 5,144,368 | 9/1992 | Ohzeki et al. . | |
| 5,151,736 | 9/1992 | Ohzeki et al. | 399/66 |
| 5,519,472 | 5/1996 | Ojima et al. . | |
| 5,541,717 | 7/1996 | Saito et al. | 399/150 |
| 5,548,381 | 8/1996 | Saito et al. | 399/55 |
| 5,570,166 | 10/1996 | Ohzeki et al. . | |
| 5,587,773 | 12/1996 | Yano et al. . | |
| 5,692,232 | 11/1997 | Okano et al. | 399/53 |

FOREIGN PATENT DOCUMENTS 5-002324 1/1993 Japan .

*Primary Examiner*—Sandra Brase

*Attorney, Agent, or Firm*—Fitzpatrick, Cella, Harper & Scinto

[57] ABSTRACT

An image forming apparatus wherein a developer remaining on a photosensitive member after an image transfer process is removed by developing means, the apparatus includes an electrophotographic photosensitive member; a contact charging means including an electrode contacted to the photosensitive member to electrically charge the photosensitive member, the contact charging means being supplied with a bias voltage form a charging bias voltage source; exposure means for exposing the photosensitive member to form an electrostatic latent image thereon after the photosensitive member is electrically charged by the charging means; developing means for supplying the developer from a developer carrying member to a latent image portion of the photosensitive member to develop the photosensitive member and simultaneously removing the developer remaining on the photosensitive member after the transfer process and conveyed to a downstream of the contact charging means on the photosensitive member, to the developer carrying member by a potential difference between the developer carrying member supplied with a developing bias and a latent image of the photosensitive member; and control means for controlling the charging bias and a developing bias, during a preparatory pre-rotation process of the photosensitive member for preparation for an image forming operation, to maintain a potential difference between the photosensitive member and the developer carrying member at a level lower than that during normal image forming operation, by surface potentials of the developer carrying member supplied with the developing bias and of the photosensitive member charged by the charging means.

12 Claims, 5 Drawing Sheets

IMAGE FORMING APPARATUS

FIELD OF THE INVENTION AND RELATED ART

The present invention relates to image forming apparatuses such as copying machines, printers, and facsimiles which use electrophotographic processes, and image forming methods compatible with these image forming apparatuses. In particular, the present invention relates to image forming apparatuses in which the toner particles remaining on the peripheral surface of an image forming apparatus are recovered by a developing means.

Referring to FIG. 5, until recently, image forming apparatuses such as copying machines, printers, and facsimiles which use an electrophotographic process have comprised a drum type electrophotographic photosensitive member as an image bearing member (hereinafter, "photosensitive member") 101, a charging device 102, an exposing apparatus 103, a developing apparatus 104, a transfer roller 105, and a cleaning apparatus 106. The photosensitive drum 101 is surrounded by the rest of the components.

When an image forming apparatus structured as described above is an image forming operation, the photosensitive member 101 is rotatively driven by a driving means (unillustrated), and as it is rotated, the peripheral surface of the photosensitive member 101 is uniformly charged by the charging device 102. The charged peripheral surface of the photosensitive member 101 is exposed to a laser beam L projected from the exposing apparatus 103. As a result, an electrostatic latent image is formed in accordance with inputted image forming data. This electrostatic latent image is developed into a toner image by a development roller 104*a* of the developing apparatus 104. Then, the toner image on the photosensitive member 101 is transferred onto a piece of transfer medium P such as a sheet of paper by the transfer roller 105. After the toner image is transferred onto the transfer medium P, the transfer medium P is delivered to a fixing apparatus (unillustrated), in which the toner image is permanently fixed to the surface of the transfer medium P. Thereafter, the transfer medium P is discharged from the fixing apparatus.

The toner particles adhering to the peripheral surface of the photosensitive member 101 after a toner image transferring process (hereinafter, "residual toner particles") are removed by the cleaning apparatus 106.

In recent years, it has been desired to reduce the operational cost and the physical size of the image forming apparatuses with the structure described above, by reducing toner consumption. For example, Japanese Laid-Open Patent Application No. 2,324/1993 discloses an image forming apparatus which employs a new cleaning system. According to this new system, the residual toner particles on the peripheral surface of an image bearing member are removed, or recovered, by a developing apparatus at the same time as an electrostatic latent image is developed by the developing apparatus.

More specifically, according to Japanese Laid-Open Patent Application No. 2,324/1993, in order to prevent "reversal cleaning phenomenon", which occurs during a so-called preparatory rotation, that is, the rotation of a photosensitive member or the like immediately preceding the start of an actual image forming process, the polarity of the developing bias voltage is temporarily switched at the beginning of the preparatory rotation, from the normal polarity for image formation to the polarity opposite to the normal polarity, and this opposite polarity is kept for a duration equivalent to the time it takes for the peripheral surface of the photosensitive member to rotate a distance equal to the distance from the charging device to the developing apparatus.

"Reversal cleaning phenomenon" means that the toner particles borne on a development roller are transferred onto the peripheral surface of a photosensitive member during a preparatory rotation period. This occurs due to the following cause. That is, after an image forming apparatus is left unused for a substantial length of time, the potential level of the peripheral surface of the development member converges to zero, and if the development member begins to be rotated in preparation for an actual image forming process in this condition, the portion of the peripheral surface of the development member, which is between the charging device and the development apparatus at the beginning of the preparatory rotation, arrives at the development apparatus without being charged, that is, with a potential level of zero. Therefore, the residual toner particles on the peripheral surface of the phototsensitive member on this portion are not recovered by the development apparatus to which development bias, that is, the bias for image formation, is being charged. In other words, not only do the residual toner particles on the above described portion of the photosensitive member fail to be cleaned, but also, the toner particles borne on the development roller transfer onto the photosensitive member.

Prior to the present invention, in an image forming apparatus employing the above described cleaning system in which residual toner particles are removed by a developing apparatus, the bias applied to the developing roller is changed from the toner recovering voltage with the polarity opposite to the normal polarity to the development voltage with the normal polarity, that is, drastically changed, during a preparatory rotation. Consequently, the electric field between an electrostatic latent image on the photosensitive member, and the development roller, also drastically changes, which causes the following problems.

As stated above, when an image forming apparatus is left unused for a substantial length of time, the surface potential of the photosensitive member 101 converges to approximately 0 (V). If the image bearing member in an image forming apparatus in this condition begins to be rotated in preparation for an actual image forming process while voltage, the polarity of which is opposite to the polarity of the normal development voltage, is applied to the development roller, the portion of the peripheral surface of the photosensitive member 101, which is between the charging device 102 and the development roller 104*a,* arrives at a development station M without being charged, and passes the development roller 104*a,* as depicted in FIG. 6.

After a certain period of time, the portion of the peripheral surface of the photosensitive member 101, which is adjacent to the charging device 102 at the beginning of the preparatory rotation, arrives at the development zone M. This portion includes a boundary N, that is, the portion which is in the interface between the charging device 102 and the photosensitive member 101 at the beginning of the preparatory rotation. Therefore, when the boundary N arrives at the development zone M, the surface potential level of the photosensitive drum 101 is substantially zero, on the downstream side of the boundary N, and is a predetermined level of $V_d$ on the upstream side, in terms of the rotational direction of the photosensitive member 101 and relative to the border N. In the case of an image forming apparatus which employs a contact type developing system, the width, in terms of the rotational direction of the photosensitive member 101, of the interface (development station M) between the development roller 104*a* and the photosensitive member 101 is generally 2–3 mm, and therefore, in some parts of this 2–3 mm wide interface, the electrical field between the development roller 104*a* and the photosensitive member 101 becomes nonuniform, although only for an extremely short period.

Generally, the toner T is coated in a thin layer on the peripheral surface of the development roller 104*a* by a toner regulating member 104*b*, and the toner particles of the toner T are triboelectrically charged by the toner regulating member 104*b* as they are coated on the development 104*a*. However, not all the toner particles are triboelectrically charged to predetermined polarity and potential level while they are coated; a certain amount of the toner particles are charged to the polarity opposite to the normal polarity. Hereinafter, these toner particles having been charged to the polarity opposite to the normal polarity will be referred to as "reverse polarity toner particles".

The change in electrical field strength in the interface (development zone M) between the development roller 104*a* and photosensitive member 101 occurs in such a direction that strengthens the force which causes the reverse polarity toner particles, that is, the toner particles having been charged to the polarity opposite to the normal polarity, to transfer from the development roller 104*a* onto the photosensitive member 101. As a result, the reverse polarity toner particles, which do not adhere to the photosensitive member 101 when the surface potential level of the photosensitive member 101 is substantially zero, do adhere to the photosensitive member 101 when the surface potential level of the photosensitive member 101 is the predetermined potential level $V_d$.

The reverse polarity toner particles having adhered to the photosensitive member 101 create various problems. For example, they contaminate the transfer roller 105 and charging device 102 depicted in FIG. 5, and also separate from the photosensitive member 101 and float in the internal space of the apparatus.

Further, the toner particles having adhered to the transfer roller 105 adhere to the back side of a transfer medium, causing so-called "back side soiling".

Further, the charging device or the transferring apparatus is in the form of a brush, a roller, or the like, which is placed in contact with the peripheral surface of the photosensitive drum, and therefore, images being formed are rendered defective by the toner particles having adhered to the roller or the like of the charging device or the transferring apparatus.

SUMMARY OF THE INVENTION

The primary object of the present invention is to provide an image forming apparatus capable of reliably outputting high quality images. This object is realized by preventing the electric field formed between the image bearing member and the developer carrying member to which bias is being applied, from drastically changing, so that the residual toner particles can be completely removed.

According to an aspect of the present invention, an image forming apparatus, in which the developer remaining on the photosensitive member after image transfer is recovered by a developing means, comprises: an electrophotographic photosensitive member; a contact type charging means which is constituted of an electrode placed in contact with the photosensitive member to charge the photosensitive member, and to which charge bias is applied by a charge bias power source; an exposing means for exposing the charged photosensitive member to form an electrostatic latent image on the photosensitive member; a developing means which transfers the residual developer particles, which are remain on the photosensitive member after toner image transfer, and are carried to the downstream side of the charging means as the photosensitive member rotates, onto the developer carrying member at the same time as it develops an electrostatic latent image formed on the photosensitive member by adhering the developer from the developer carrying member to the latent image; and a controlling means which controls the charge bias and the development bias so that the difference in surface potential level between the developer carrying member to which development bias is being applied, and the portion of the peripheral surface of the photosensitive member, which is charged by the charging means prior to its arrival at the developer carrying member, remains small during a period in which the photosensitive member is rotated in preparation for an actual image forming process.

These and other objects, features and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the drawings.

EMBODIMENT 1

Figure 1:
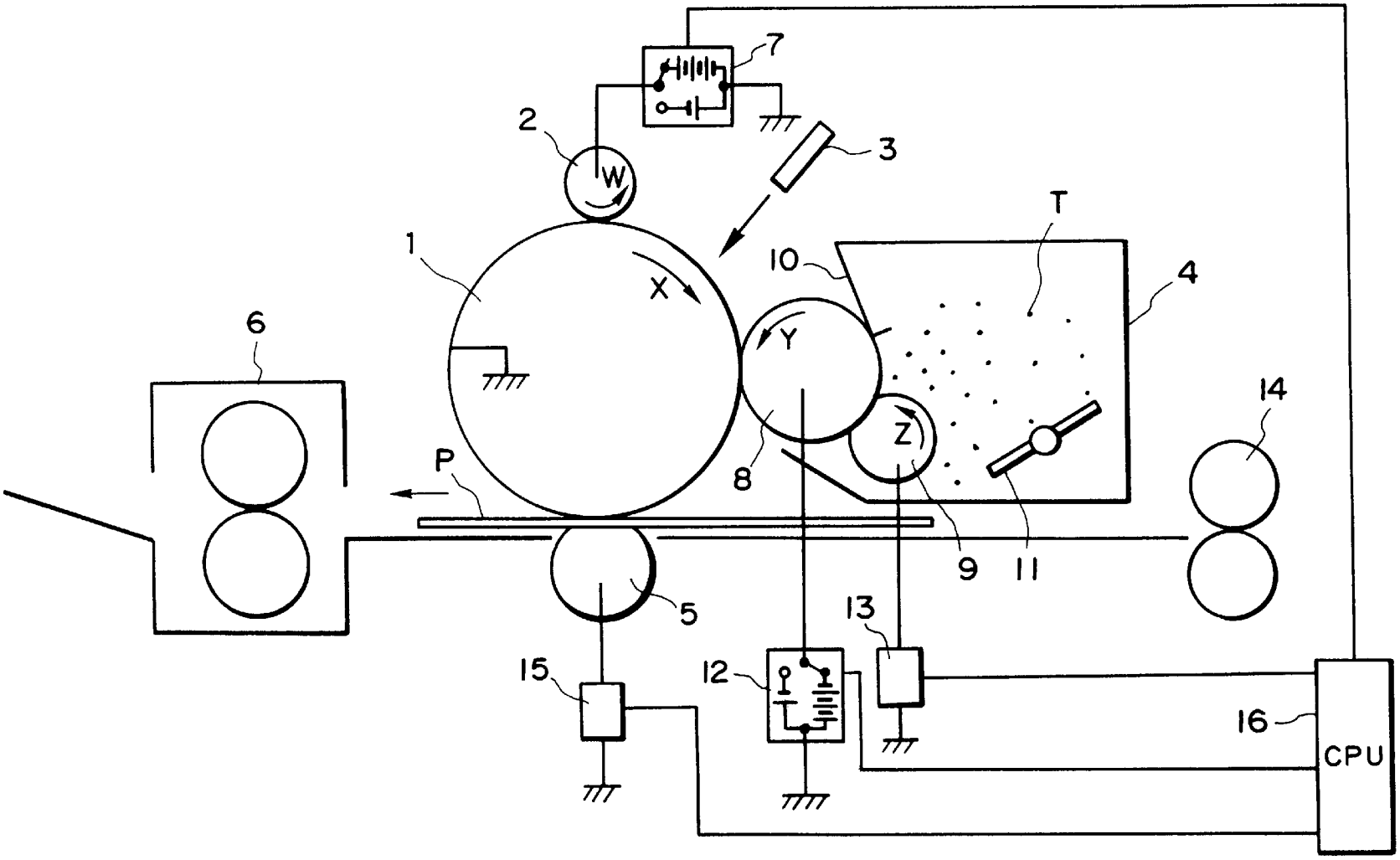
FIG. 1 is a schematic vertical section of the image forming apparatus in the first embodiment of the present invention, and depicts the general structure of the apparatus.

FIG. 1 is a schematic vertical section of the image forming apparatus pertaining to the first embodiment of the present invention, and depicts the general structure thereof. This apparatus is of a type in which a cleaning apparatus is absent, and the residual toner particles on the peripheral surface of the photosensitive member are removed by the developing apparatus at the same time as the developing apparatus develops an electrostatic latent image. This image forming apparatus comprises: a photosensitive member 1 in the form of a drum, a charge roller 2, an exposing apparatus 3, a developing apparatus 4, a transfer roller 5, and a fixing apparatus 6. The photosensitive member 1 is surrounded by the rest of the components.

The photosensitive member 1 is provided with a photosensitive layer (unillustrated), which constitutes the surface layer thereof. It is rotated in the clockwise direction indicated by an arrow mark X, at a predetermined peripheral velocity.

The charge roller 2, a contact type charging means, is placed in contact with the photosensitive member 1 to charge the photosensitive member 1, and is rotated in the counterclockwise direction indicated by an arrow mark W at a peripheral velocity of $V_w$. The peripheral velocity $V_w$ of the charging roller 2 is desired to be greater than the peripheral velocity $V_x$ of the photosensitive member 1: $V_w>V_x$. This is due to the following reason. Since the image forming apparatus in this embodiment is such an image forming apparatus that cleans the image bearing member by the developing apparatus while the developing apparatus is developing a latent image, the residual toner particles, that is, the toner particles which have failed to be transferred by the transfer roller 5 and are remaining on the photosensitive member 1 after toner image transfer, go through the interface between the photosensitive member 1 and the charge roller 2 and reach the development zone. Thus, a certain amount of the residual toner particles adhere to the charge roller 2, or contaminate the peripheral surface of the charge roller 2. In order to prevent this contamination of the charge roller 2, it is desirable that the above inequity $V_x>V_w$ is satisfied. In this embodiment, the peripheral velocities $V_x$ and $V_w$ of the photosensitive member 1 and the charge roller 2 are set at 93 mm/sec and 123 mm/sec, respectively.

To the charge roller 2, a charge bias power source 7 is connected, which applies a voltage of approximately −1,300 V to the charge roller 2 to uniformly charge the peripheral surface of the photosensitive member 1 to a potential level of −700 V.

The exposing apparatus 3 forms an electrostatic latent image on the peripheral surface of the photosensitive member 1 by exposing the charged peripheral surface of the photosensitive member 1 to a laser beam, an LED light, or the like, modulated with the image formation data inputted into the exposing apparatus 3.

The developing apparatus 4, which contains nonmagnetic single component toner T as developer, comprises: a development roller 8 which is placed in contact with the photosensitive member 1 and is rotated in the counterclockwise direction indicated by an arrow mark Y at a peripheral velocity of $V_y$; a coating roller 9 which is rotated in the counterclockwise direction indicated by an arrow mark Z; a development blade 10, as a toner regulating member, which coats the developer on the development roller 8; and a stirring member 11 for stirring the nonmagnetic single component toner T. The relationship between the peripheral velocities $V_x$ and $V_y$ of the photosensitive member 1 and the development roller 8, respectively, is $V_y>V_x$. In this embodiment, the peripheral velocity $V_y$ of the development roller 8 is set at 145 mm/sec.

The development roller 8 is connected to a development bias power source 12, which is a DC power source with negative polarity. In this embodiment, the power source 12 is provided with a capacity to change the potential of the development roller 8 to −350 V as it applies development bias to the development roller 8.

The development roller 8 is a so-called elastic roller, which comprises a metallic core, and an elastic layer which covers the metallic core. In this embodiment, the development roller 8 is an elastic development roller with a diameter of 14 mm, and comprises a stainless rod, as the metallic core, with a diameter of 10 mm, and a 2 mm thick silicone rubber layer, as the elastic layer, which covers the stainless rod. Although the development roller 8 in this embodiment is coated with only a single layer of silicone rubber, there is no problem if the development roller 8 has a multi-layer structure. For example, from the standpoint of desirably charging the toner T, the surface of the elastic rubber layer may be coated with material effective to charge the toner T. As for the material for the elastic layer, silicone rubber is employed in this embodiment, but in addition to the silicone rubber, ordinary rubber, for example, NBR rubber, EPDM rubber (ethylene rubber, butadiene rubber), urethane rubber, or the like, may be also used.

The hardness of the rubber to be used as the material for the elastic layer is desired to be within a range of 20–65 degrees (JISA). If the hardness of the rubber is higher than 65 degrees (JISA), the rubber does not have sufficient elasticity, reducing therefore the size of the interface between the photosensitive member 1 and the development roller 8, and as a result, it becomes difficult for the development roller 8 to desirably develop a latent image.

Further, if the hardness of the elastic layer is high, the pressure (contact pressure) generated between the development roller 8 and the photosensitive member 1 as the peripheral surfaces of the development roller 8 and photosensitive member 1 meet is affected more drastically by the change in the distance between the rotational axes of the development roller 8 and photosensitive member 1 than when the hardness of the elastic layer is low. Therefore, it is not desirable also from the standpoint of manufacturing tolerance that the hardness of the material for the elastic layer is higher than the aforementioned range. In addition, if the hardness of the rubber is 20 degrees (JISA) or less, the amount of permanent deformation caused to the rubber layer increases. In order words, the elastic layer is liable to be deformed while the image forming apparatus is left unused. Therefore, it is not desirable that the hardness of the rubber is 20 degrees (JISA) or less.

The electrical resistance of the development roller 8 is desired to be low enough to render the development roller 8 electrically conductive so that the toner T is prevented from being triboelectrically charged up. However, in consideration of the possibility that there may be pin holes in the peripheral surface of the photosensitive member 1, and excessive current may flow through these pin holes, the development roller 8 may comprise a thin film layer (unillustrated) for adjusting the electrical resistance of the development roller 8. The volumetric electrical resistivity of the development roller 8 is desired to be in a range of IE3–IE9 Ω.cm.

The development blade 10 as the toner regulating member is constituted of a piece of thin stainless plate (approximately 0.1 mm thick) bent at approximately 2 mm from the longitudinal edge in the direction opposite to the development roller 8. It is placed in contact with the development roller 8 in such a manner that the bent portion of the development roller 8 presses slightly into the surface of the development roller 8. The linear contact pressure between the bent portion of the development blade 10 and the development roller 8 is approximately 20 g/cm. The material for the development blade 10 in this embodiment is thin stainless plate, but a so-called elastic blade, the flat surface portion of which is placed in contact with the development roller 8, may be used instead of this bent piece of thin stainless plate in this embodiment.

The particle shape of the nonmagnetic single component tone T held in the developing apparatus 4 may be irregular, or nonspherical, such as the particle shape of the toner formed by pulverization or the like, or may be substantially spherical as the particle shape of the toner formed by polymerization or the like. However, in comparison to the toner particles with irregular shape, the spherical toner particles more easily roll in the interface between the development roller 8 and the photosensitive member 1, being triboelectrically charged more uniformly. Therefore, when the toner composed of spherical toner particles is used, fogging is less likely to occur, and also, the amount of toner particles which scatter and adhere to the background portions of an image is reduced, improving thereby the uniformity of the final image. Further, the toner composed of substantially spherical toner particles is superior to the toner composed of nonspherical toner particles formed by pulverization or the like, in terms of reducing the amount of the toner particles which remain on the image bearing member after image transfer. Thus, in the case of a "cleanerless" image forming apparatus, it is preferable to use toner composed of substantially spherical toner particles.

In order to adhere the toner T held in the developing apparatus 4 to the development roller 8, the toner T must be triboelectrically charged by the coating roller 9 and the development roller 8. As for the material for the coating roller 9, widely used rubber such as foamed urethane rubber or foamed EPDM rubber may be used. The coating roller 9 in this embodiment is formed of foamed urethane rubber, and is rotated in the direction indicated by an arrow mark Z so that the moving directions of the peripheral surfaces of the coating roller 9 and the development roller 8 become opposite in their interface. In this embodiment, the peripheral velocity $V_z$ of the coating roller 9 is set at 70 mm/sec. The coating roller 9 is connected to a coating bias power source 13, from which a voltage of approximately −460 V is applied to the coating roller 9 to drive the negatively charged toner particles T from the coating roller 9 to the development roller 8. Then, the negatively charged toner particles T adhere to the peripheral surface of the photosensitive member 1, on the areas with no charge; in other words, the electrostatic latent image on the peripheral surface of the photosensitive member 1 is reversely developed.

The transfer roller 5 constitutes a roller type transferring means, and transfers a toner image formed on the peripheral surface of the photosensitive member 1 onto a piece of transfer medium P as the transfer medium P is delivered to a transfer zone by a conveyer roller 14. The transfer roller 15 is connected to a transfer bias power source 15. In this embodiment, the peripheral surface of the transfer roller 5 is charged to a potential level of approximately +2 kV as voltage is applied to the transfer roller 5 from the transfer bias power source 15.

The charge bias power source 7, development bias power source 12, coating bias power source 13, and transfer bias power source 15 are connected to a controlling apparatus (CPU) 16, which controls the voltages applied from the charge bias power source 7, development bias power source 12, coating bias power source 13, and transfer bias power source 15 to corresponding devices and apparatuses. This control will be described later in detail.

Next, the image forming operation of the image forming apparatus described above will be described.

In the image forming operation, the photosensitive member 1 is rotatively driven in the direction of the arrow X at a predetermined peripheral velocity (93 mm/sec) by a driving means (unillustrated). As the photosensitive member 1 is rotated, charge bias is applied to the charge roller 2 from the charge bias power source 7 to charge the peripheral surface of the photosensitive member 1.

Then, the charged peripheral surface of the photosensitive member 1 is exposed to a laser beam or an LED light by the exposing apparatus 3. As a result, an electrostatic latent image is formed on the peripheral surface of the photosensitive member 1, in accordance with the image forming data inputted to the exposing apparatus 3. This electrostatic latent image on the photosensitive member 1 is reversely developed by the developing apparatus 4; the toner particles charged to negative polarity, that is, the same polarity as that of the electrostatic latent image, are attached to the electrostatic latent image to visualize the latent image into a toner image.

As the toner image on the photosensitive member 1 arrives at a transfer nip (transfer zone) between the transfer roller 5 and the photosensitive member 1, the transfer medium P is delivered to the transfer nip with the same timing as the arrival of the toner image. In the transfer nip, positive charge is given to the back side of the transfer medium P by the transfer roller 5 to which transfer bias is being applied from the transfer bias power source 15, and as a result, the toner image on the photosensitive member 1 is transferred onto the front side of the transfer medium P. After the toner image transfer, the transfer medium P is conveyed to the fixing apparatus 6, in which the toner image is permanently fixed to the transfer medium P. Thereafter, the transfer medium P with the permanent toner image is discharged from the fixing apparatus 6.

According to an aspect of the present invention, the amount of the toner particles which are charged to the polarity opposite to the normal polarity in the developing apparatus, and adhere to the photosensitive member 1 during a preparatory rotation immediately before the beginning of an actual image forming process is minimized by preventing the magnitude of the electrical field generated between the peripheral surfaces of the photosensitive member 1 and the development roller 8 from drastically changing. More specifically, the magnitude of the electrical field generated between the peripheral surfaces of the photosensitive member 1 and the development roller 8 is prevented from drastically changing by changing (increasing) the surface potential level (potential level to which the peripheral surface of the photosensitive member 1 is charged) of the photosensitive member 1, and the voltage applied to the development roller 8, in steps.

Next, referring to the bias controlling sequences given in FIG. 2, the rotation of the image bearing member immediately before an actual image forming process in the aforementioned image forming apparatus will be described. The charge bias applied to the charge roller 2, the development bias applied to the development roller 8, the transfer bias applied to the transfer roller 5, and the toner coating bias applied to the coating roller 9, are controlled by the controlling apparatus (CPU) 16.

Figure 2:
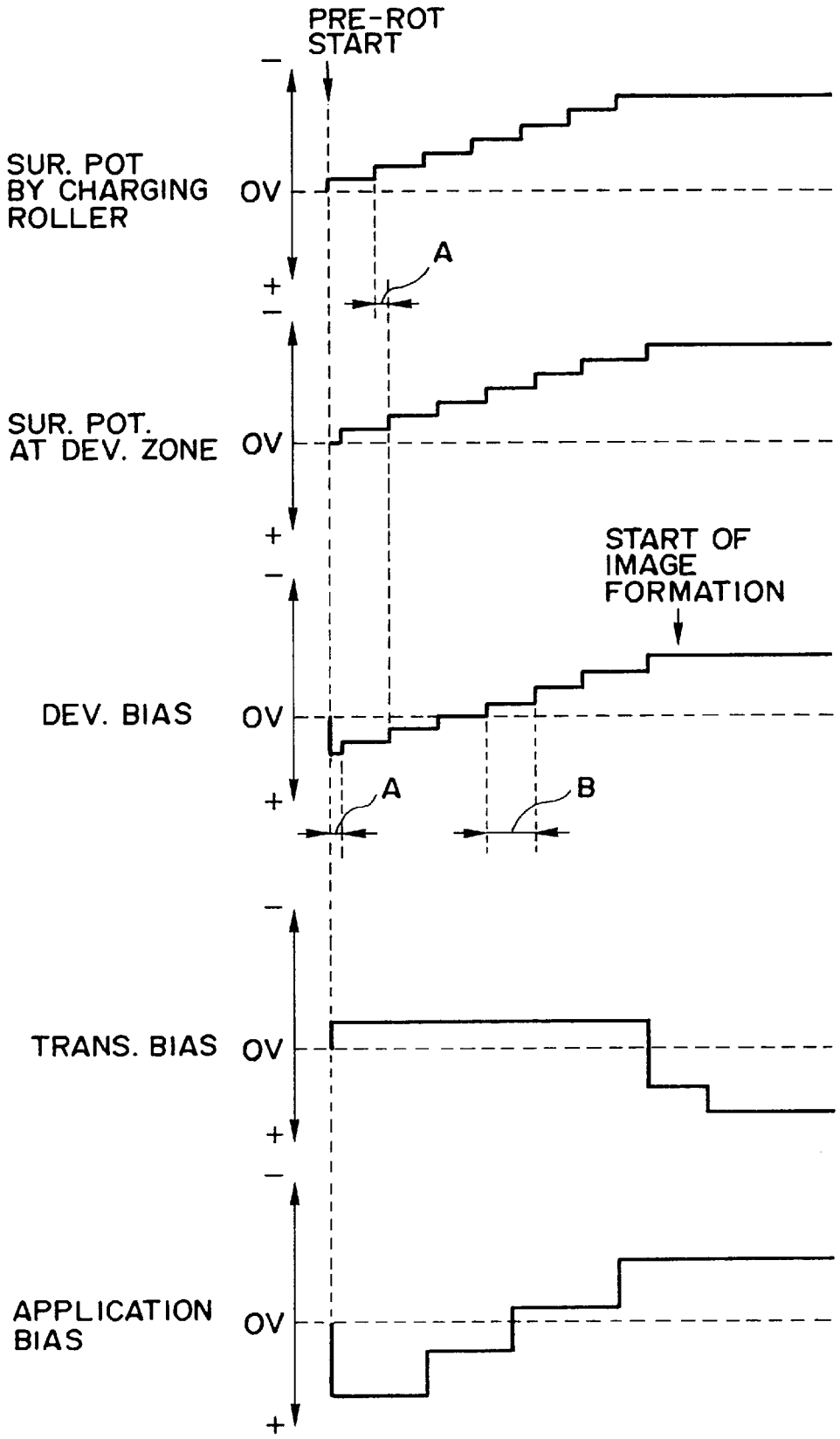
FIG. 2 is a graph which depicts the bias controlling sequences in the first embodiment, followed at the beginning of an image forming operation.

In this embodiment, variable power sources are employed as the development bias power source 12 and the charge bias power source 7, respectively, so that the magnitude of the voltage outputted by these power sources can be controlled, or changed, by the signal from the controlling apparatus (CPU) 16 as depicted in FIG. 2.

There are other methods for changing the magnitude of the voltage outputted by these power sources. For example, the output of a high power amplifier may be modulated with an analog signal outputted from the controlling apparatus (CPU) 16 (high voltage may be outputted in response to a low voltage analog signal). In other words, it is possible to change the magnitude of the voltage output of a power source by controlling the analog output of the controlling apparatus (CPU) 16.

Prior to the beginning of the preparatory rotation of the photosensitive member 1, the voltage level of all of the aforementioned power sources are 0 V. With the voltage of all power sources at 0 V, an image formation start signal is inputted to start the preparatory rotation of the photosensitive member 1. At this point in time, charge bias begins to be applied to the charge roller 2, and therefore, the surface potential level of the photosensitive member 1 in the interface between the charge roller 2 and the photosensitive member 1 beings to rise. More specifically, a charge bias of approximately −700 V begins to be applied to the charge roller 2, and as a result, the peripheral surface of the photosensitive member 1 is charged to −100 V which equals the difference between the applied charge bias and the charge threshold voltage of the photosensitive member 1 (−700 V−−600 V).

Also prior to the beginning of the preparatory rotation of the photosensitive member 1, the potential level of the peripheral surface of the photosensitive member 1 has attenuated to substantially 0 V while the image forming apparatus is left unused; in other words, the portion of the peripheral surface of the photosensitive member, which is between the charging zone, that is, the interface between the photosensitive member 1 and the charge roller 2, and the development zone, that is, the interface between the photosensitive member 1 and the development roller 8, at the beginning of the preparatory rotation, is substantially 0 V. Thus, the surface potential of the photosensitive member on immediately upstream side of the development zone remains at 0 V until the portion of the peripheral surface of the photosensitive member 1, which is in the interface between the charge roller 2 and the photosensitive member 1 at the beginning of the preparatory rotation, arrives at the development zone.

Also at the beginning of the preparatory rotation of the photosensitive member 1, a positive voltage of −350 V begins to be applied to the development roller 8 from the development bias power source 12 to recover the residual toner particles on the photosensitive member 1. During this period, the difference in voltage between the potential level of the peripheral surface of the photosensitive member 1 and the bias applied to the development roller 8 is desirable to be in a range of 100–500 V. If this difference is no more than 100 V, the efficiency with which the residual toner particles on the photosensitive member 1 are recovered reduces; the residual toner particles on the photosensitive member 1 cannot be satisfactorily recovered. On the other hand, if the difference is no less than 500 V, toner particles charged to the polarity opposite to the normal polarity are transferred to the photosensitive member 1 from among the toner particles borne on the development roller 8, as they do in a "cleanerless" image forming apparatus based on the prior art; in other words, the peripheral surface of the photosensitive member 1 cannot be satisfactorily cleaned by the development roller 8.

Also at the same time as the preparatory rotation of the photosensitive member 1 is started, negative voltage begins to be applied from the transfer bias power source 15 to the transfer roller 5 so that the toner particles with the normal polarity, which are adhering to the transfer roller 5, are transferred back to the photosensitive member 1. In this embodiment, the bias applied to the transfer roller 5 during this period is −1 kV.

The bias applied to the coating roller 9 from the coating bias power source 13 is on the positive side on a voltage scale relative to the bias which begins to be applied to the development roller 8 at the same time as the preparatory rotation begins. This arrangement is made to strip the residual toner particles recovered onto the development roller 8 in the development zone, from the development roller 8, to prevent the toner particles from being borne on the development roller 8 in an excessive amount. The magnitude of the voltage applied to the coating roller 9 during this period in this embodiment is +500 V.

As the photosensitive member 1 is farther rotated, the portion of the peripheral surface of the photosensitive member 1 in contact with the peripheral surface of the charge roller 2 at the beginning of the preparatory rotation of the photosensitive member 1, enters the development zone. This portion of the peripheral surface of the photosensitive member 1 includes a boundary, on one side of which, potential level is substantially zero, and on the other side of which, potential level has been changed to approximately −100 V by the charge roller 2. At the moment this boundary arrives at the development zone, the developing bias applied to the development roller 8 is changed from the aforementioned +350 V to +250 V.

At this moment, the maximum difference in potential level between the development roller 8 and the photosensitive member 1 is 450 V, that is, the difference between +350 V being applied to the development roller 8 and −100 V at the peripheral surface of the photosensitive member 1. This voltage of 450 V is within the aforementioned desirable potential level difference range. Therefore, the phenomenon that the toner particles on the development roller 8, which have been charged to the polarity opposite to the normal toner particle polarity, transfer to the photosensitive member 1, does not occur. Thus, even when the contact type charge roller 2 and/or the contact type transfer roller 5 are employed, the phenomenon that the photosensitive member 1 is contaminated by these members does not occur.

After the photosensitive member 1 is rotated at least one full turn since the beginning of the preparatory rotation of the photosensitive member 1, the level of the electrical potential applied from the charge bias power source 7 to the charge roller 2 is changed from −700 V to −800 V. Then, after the elapsing of a length of time equivalent to the time it takes for the peripheral surface of the photosensitive member 1 to move a distance equivalent the distance from the charge roller 2 to the development zone (duration indicated by a letter A) from the point in time when the electrical potential level of the charge bias power source 7 is changed, the potential level of the bias applied from the development bias power source 12 to the development roller 8 is changed by 100 V, that is, from the +250 V to +150 V. This potential level change sequence is carried out for each full turn of the photosensitive member 1 (period indicated by a letter B is the time necessary for the photosensitive member 1 to rotate one full turn) until the potential level of the bias applied to the charge roller 2 reaches −1300 V, and the potential level of the developing bias applied to the development roller 8 from the development bias power source 12 reaches −350 V, that is, until the image forming apparatus becomes ready for an actual image forming process.

After the voltage of the development bias power source 11 reaches −350 V, weak positive bias is applied to the transfer roller 5 for a predetermined duration immediately before the beginning of the actual image forming process. This weak bias is a voltage of +1 kV in this embodiment. Then, after the elapsing of this predetermined period of time, the bias applied to the transfer roller 5 is switched from this weak positive bias with a potential level of +1 kV to a bias with a potential level of +2 kV, that is, the normal transfer bias, and the actual image forming process is started. The reason for applying the normal transfer bias to the transfer roller 5 after applying the weak positive bias to the transfer roller 5 is to prevent the back side of the transfer medium P from being soiled, at the portion correspondent to the leading edge of the image.

The toner coating bias applied to the coating roller 9 is changed as the output of the development bias power source 12 is changed. However, the number of steps in which the toner coating bias is changed does not need to be as many as the number of steps in which the developing bias applied to the development roller 8 is changed, because the potential level of the toner coating bias applied to the coating roller 9 has only to be in a range in which leak does not occur between the development roller 8 and the coating roller 9, and therefore, it does not need to be changed as strictly as the other biases. Obviously, there is no problem in changing the toner coating bias applied to the coating roller 9 in synchronism with the changing of the developing bias applied to the development roller 8.

After the operational sequence described is completed, in other words, as soon as the voltage output of the charge bias power source 7 and the development bias power source 12 reaches the predetermined values and the preparatory rotation of the photosensitive member 1 is ended, the actual image forming process is started to place a toner image on the transfer medium P.

According to the results of the tests in which the sequences described above were practiced, even when the preparatory rotation is started while the electrical potential level of the peripheral surface of the photosensitive member 1 is substantially zero, toner particles did not adhere to the photosensitive member 1; the back side contamination of the transfer medium P, which frequently occurs in the case of a conventional "cleanerless" image forming apparatus, did not occur, proving the effectiveness, or superiority, of a "cleanerless" image forming apparatus in accordance with the present invention, in cleaning an image bearing member of the toner particles remaining on the peripheral surface thereof after image transfer.

As is evident from the description given above, according to this embodiment of the present invention, the surface potential level of the photosensitive member 1 and the voltage applied to the development roller 8 are changed in steps to prevent the magnitude of the electrical field between the peripheral surfaces of the photosensitive member 1 and the development roller 8, from drastically changing. Therefore, the toner particles charged to polarity opposite to the normal toner polarity are prevented from adhering to the photosensitive member 1. Thus, even when a charging member or a transferring member of the contact type is employed, such problems that the transfer roller 5 and/or the charge roller 2 are contaminated by toner particles, and that toner particles are scattered in the internal space of an image forming apparatus, or the like problems do not occur, making it possible to reliably produce high quality images.

EMBODIMENT 2

Figure 3:
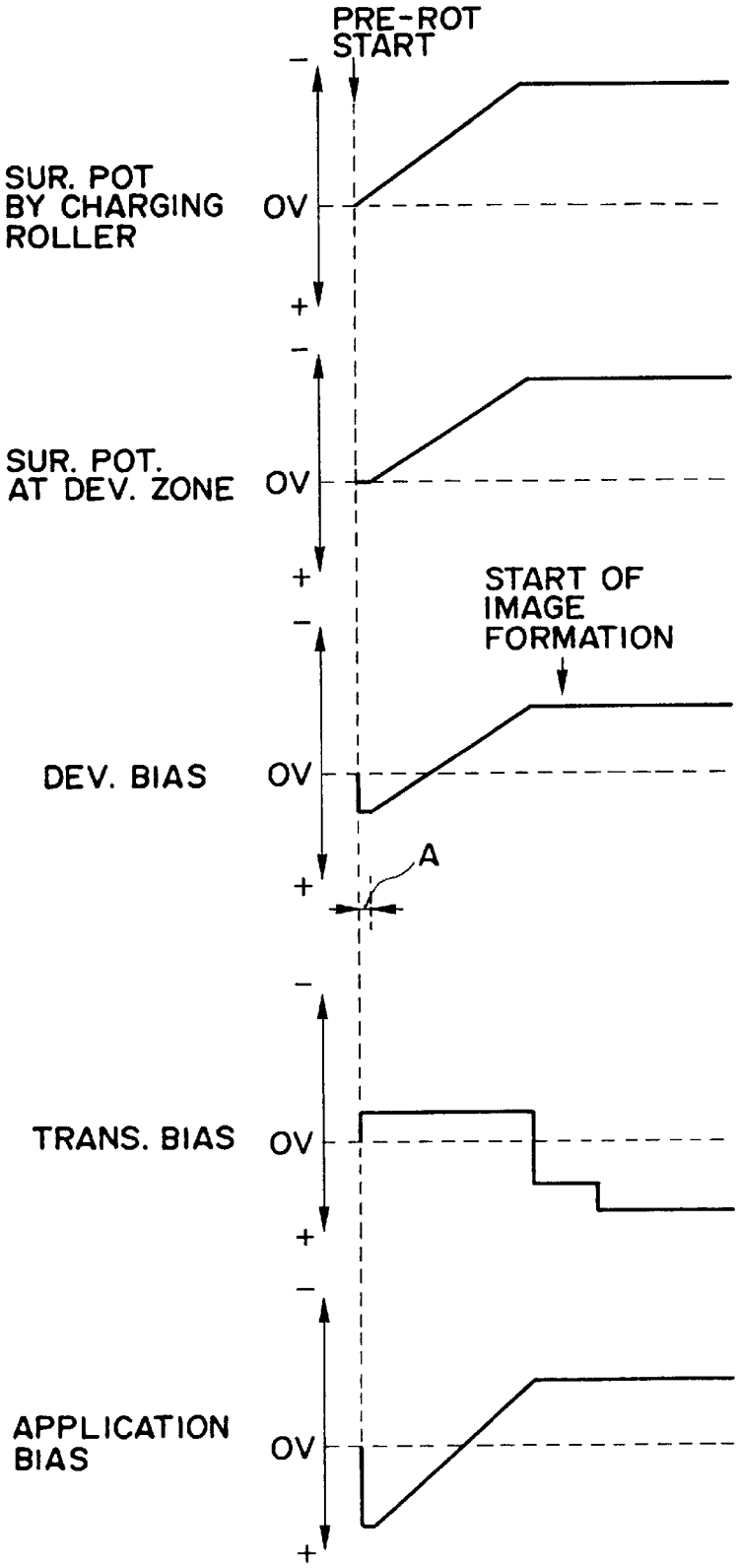
FIG. 3 is a graph which depicts the bias controlling sequences in the second embodiment of the present invention, followed at the beginning of an image forming operation.

FIG. 3 is a graph which depicts the bias controlling sequence carried out at the beginning of an image forming operation in this embodiment. Also in this embodiment, the biases applied to the charge roller 2, development roller 8, transfer roller 5, and coating roller 9 during the preparatory rotation of the photosensitive member 1 are controlled by the controlling apparatus 16 as they are in the first embodiment.

According to this embodiment, the surface potential level of the photosensitive member 1 and the voltage applied to the development roller 8 are steplessly and continuously changed to prevent the magnitude of the electric field formed between the peripheral surfaces of the photosensitive member 1 and the development roller 8, from drastically changing, so that the toner particles charged to the polarity opposite to the normal toner polarity are prevented from adhering to the photosensitive member 1.

Referring to FIG. 3, prior to the beginning of the preparatory rotation, all the biases mentioned above are at a potential level of 0 V as they are according to the first embodiment. Then, a signal is inputted and the preparatory rotation of the photosensitive member 1 is started. At the same time as the preparatory rotation of the photosensitive member 1 is started, charge bias begins to be charged to the charge roller 2, and therefore, the potential level of the portion of the peripheral surface of the photosensitive member 1 in contact with the charge roller 2 begins to be charged from this moment.

During this preparatory rotation period, the potential level of the charge bias applied to the charge roller 2 is linearly increased from a level, the absolute value of which equals the absolute value of the charge start threshold value for the photosensitive member 1, that is, from −600 V in this embodiment, to a level, the absolute value of which equals the sum of the absolute values of the target surface potential level of the photosensitive member 1 and the charge start threshold value for the photosensitive member 1, to linearly increase the surface potential level of the photosensitive member 1 in the direction of negative polarity. More specifically, the voltage output of the charge bias power source 17 is linearly increased until the surface potential level of the photosensitive member 1 reaches −700 V; in other words, the voltage output of the charge bias power source 17 is continuously and linearly increased for a predetermined period of time, that is, until it reaches approximately −1,300 V.

As for the surface potential of the portion of the photosensitive member 1 in the development zone at the beginning of the preparatory rotation period, it has converged to substantially 0 V while the image forming apparatus was left unused or on standby. Therefore, the potential level of any point of the peripheral surface of the photosensitive member 1, which is between the charge roller 2 and the development roller 8 when the preparatory rotation is started, remains at 0 V until the point reaches the development zone.

As for the bias applied to the development roller 8, at the same time as the preparatory rotation is started, positive voltage is applied to the development roller 8 to recover the toner particles remaining on the photosensitive member 1 after image transfer. According to this embodiment, this positive voltage is +350 V. A period designated by a character A in FIG. 3 is equivalent to the time it takes for the peripheral surface of the photosensitive member 1 to move a distance equal to the distance from the charge roller 2 to the development zone.

By the time the portion of the peripheral surface of the photosensitive member 1 which is in contact with the peripheral surface of the charge roller 2 when the preparatory rotation is started arrives at the development zone by the rotation of the photosensitive member 1, the surface potential level of the photosensitive member 1 at the interface between the charge roller 2 and the photosensitive member 1 is gradually increased from 0 V in the negative direction by the charge bias. During this period, the potential level of the developing bias applied to the development roller 8 is increased from the aforementioned +350 V at the same ratio as the ratio with which the surface potential level of the photosensitive member 1 increases. In other words, the bias applied to the development roller 8 during this period is modulated to maintain a constant difference of 350 V between the surface potential levels of the photosensitive member 1 and the development roller 8, so that the toner particles are adhered to the development roller 8.

With the above arrangement, the difference in potential level between the surface potential of the photosensitive member 1 and the developing bias applied to the development roller 8 is within a desirable potential level difference range of 100–500 V. Therefore, the aforementioned phenomenon that the toner particles charged to the polarity opposite to the normal toner polarity transfer from the development roller 8 to the photosensitive member 1 does not occur.

As the operational sequence described above is completed, that is, as the voltage outputs of the charge bias power source 7 and the development bias power source 12 reach −1,300 V and −350 V, respectively, the image forming apparatus becomes ready for an actual image forming process. As for the bias applied to the transfer roller 5, weak negative voltage is applied to the transfer roller 5 from the beginning of the preparatory rotation.

With the application of the weak negative bias to the transfer roller 5, force is generated in the direction to cause the toner particles adhering to the transfer roller 5 to return to the photosensitive member 1. According to this embodiment, the potential level of this bias applied to the transfer roller 5 is −1 kV. After the potential level of the development bias power source 12 reaches −350 V, weak positive bias begins to be applied to the transfer roller 5 immediately before the start of the actual image forming process for a predetermined length of time. The potential level of this weak bias is approximately +1 kV. Then, after the elapsing of a predetermined length of time from the start of the actual image forming process, the bias applied to the transfer roller 5 is changed from this weak positive bias to +2 kV, that is, the normal potential level of the transfer bias to carry out the actual image forming process.

As for the toner coating bias applied to the coating roller 9, a voltage much greater in the negative direction on the voltage scale than the voltage applied to the development roller 8 begins to be applied at the beginning of the preparatory rotation. This arrangement is made to strip the residual toner particles recovered by the development roller 8 in the development zone, from the development roller 8, so that the amount of the toner borne on the development roller 8 is prevented from becoming excessive. According to this embodiment, this toner coating bias applied to the coating roller 9 is −500 V.

The toner coating bias is increased along with the increase of the potential level of the developing bias applied to the development roller 8 from the development bias power source 12. The rate with which the toner coating bias is increased is rendered greater than the rate with which the bias applied to the development roller 8 is increased. This arrangement is made to make the potential level of the toner coating bias greater in the negative direction on the voltage scale than the potential level of the developing bias applied to the development roller 8. Thus, at the beginning of the preparatory rotation, the potential level of the toner coating bias is greater in the positive direction on the voltage scale than that of the bias applied to the development roller 8, but by the time the image forming apparatus becomes ready for the actual image forming process, the potential level of the toner coating bias becomes greater in the negative direction than that of the bias applied to the development roller 8.

As the operational sequence described above is completed, that is, as the outputs of the charge bias power source 7 and the development bias power source 12 reach the predetermined potential levels, respectively, and the preparatory rotation ends, the actual image forming process is started, whereby a toner image is placed on the transfer medium P.

The effects obtained when the preparatory rotation sequence in accordance with this second embodiment was carried out were the same as those obtained when the preparatory rotation sequence in accordance with the first embodiment was carried out.

As is evident from the description given above, according to this embodiment, the surface potential level of the photosensitive member 1 and the voltage applied to the development roller 8 are steplessly and continuously changed to prevent the magnitude of the electrical field between the peripheral surfaces of the photosensitive member 1 and the development roller 8, from drastically changing. Therefore, the toner particles charged to polarity opposite to the normal toner polarity are prevented from adhering to the photosensitive member 1. Thus, such problems that the transfer roller 5 and/or the charge roller 2 are contaminated by toner particles, and that toner particles are scattered in the internal space of an image forming apparatus, or the like problems do not occur, making it possible to reliably produce high quality images.

Further, according to this embodiment, the surface potential level of the photosensitive member 1 and the voltage applied to the development roller 8 are steplessly changed, and therefore, the difference in the potential level between the surface potential of the photosensitive member 1 and the voltage applied to the development roller 8 remain constant, reducing the time necessary for the preparatory rotation.

EMBODIMENT 3

Figure 4:
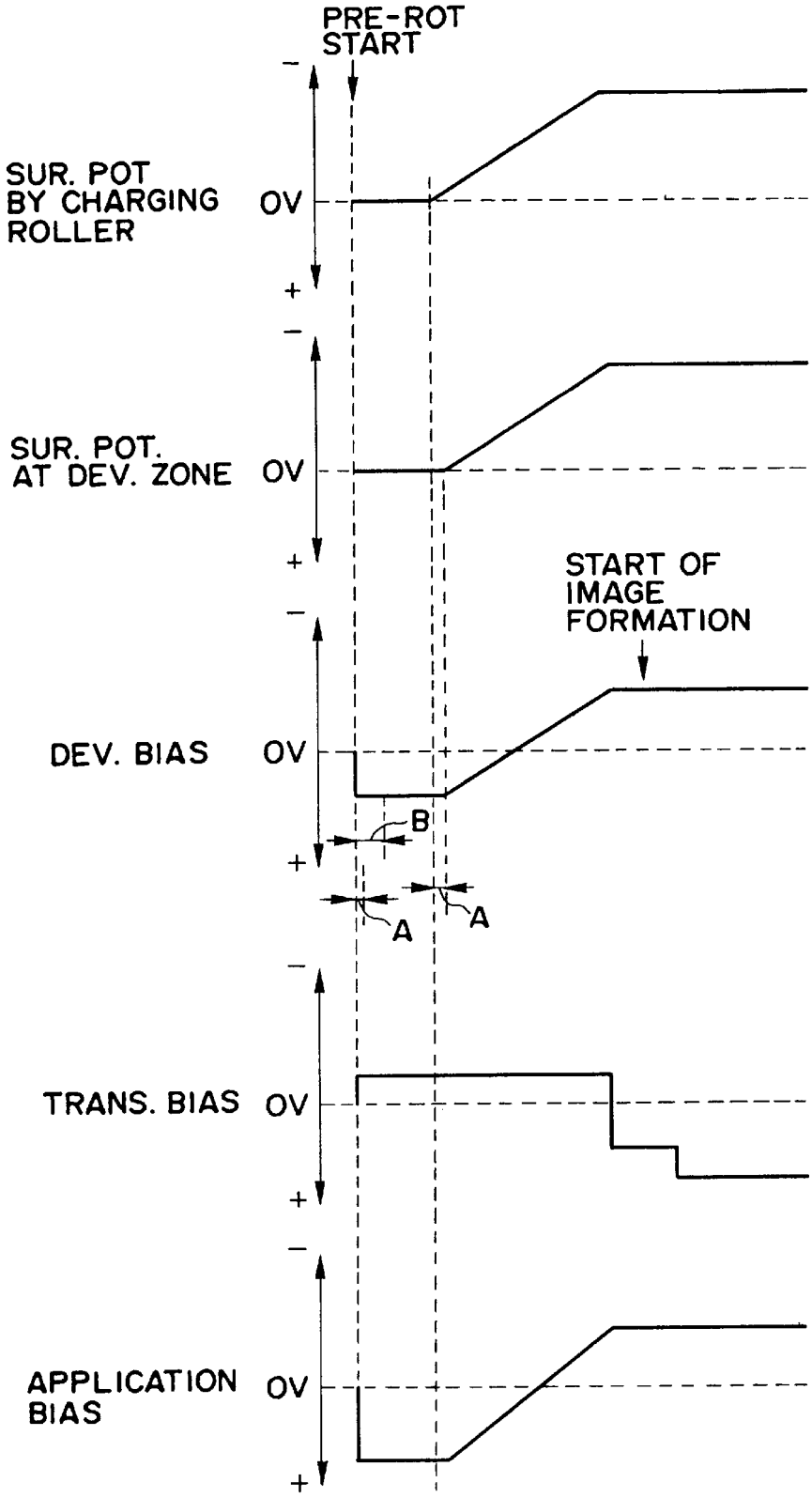
FIG. 4 is a graph which depicts the bias controlling sequences in the third embodiment, followed at the beginning of an image forming operation.
Figure 5:
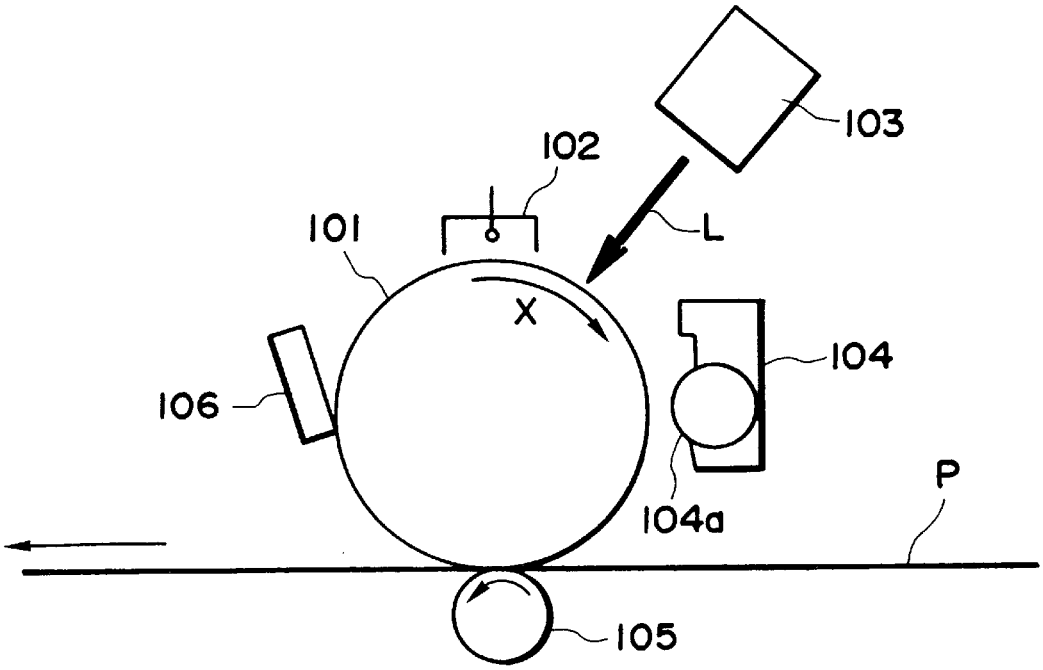
FIG. 5 is a schematic vertical section of a conventional image forming apparatus, that is, an apparatus based on the technology prior to the present invention.
Figure 6:
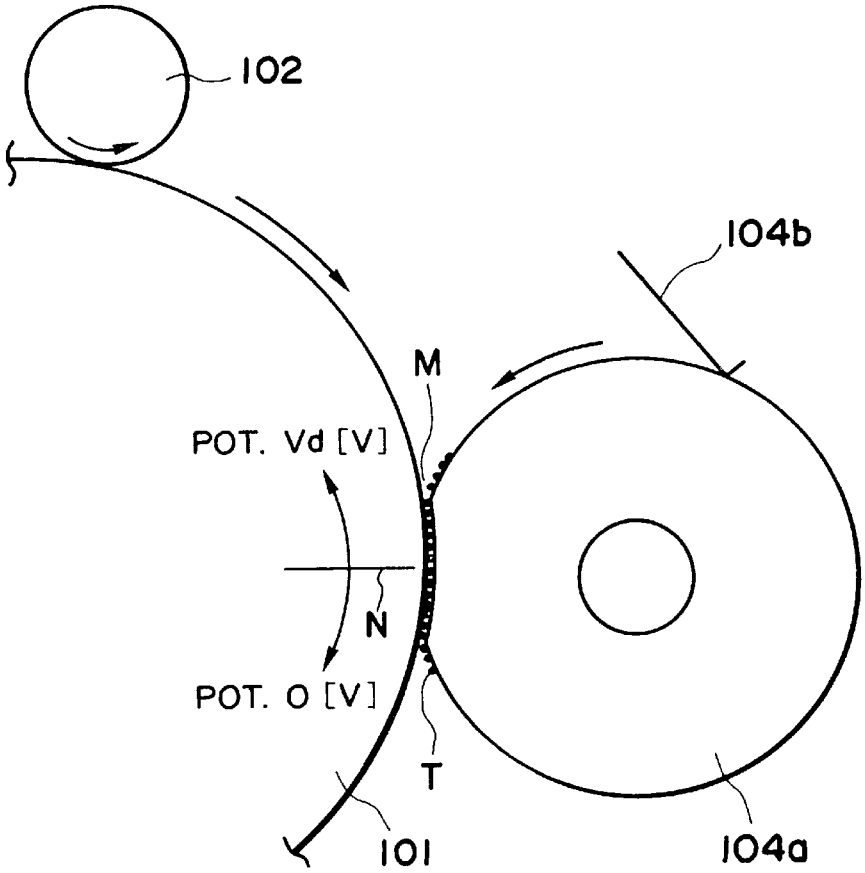
FIG. 6 is a schematic section of the interface between the photosensitive member and the development roller in the conventional image forming apparatus, and the adjacencies thereof.

FIG. 4 is a graph which depicts the bias control sequence in the third embodiment of the present invention carried out at the beginning of an image forming operation. Also in this embodiment, the biases applied to the charge roller 2, development roller 8, transfer roller 5, and coating roller 9 during the preparatory rotation of the photosensitive member 1 are controlled by the controlling apparatus 16 as they are in the first embodiment.

This third embodiment of the present invention pertains to an operation for restoring the normal condition of a "cleanerless" image forming apparatus after the apparatus is forced to stop by a paper jam or the like.

When an image forming apparatus is forced to stop by a paper jam or the like during an actual image forming operation, the toner particles, as the constituents of a toner image, or a visible image, which are adhering to the peripheral surface of the photosensitive member 1, are between the development zone and the transfer roller 5. In the case of a "cleanerless" image forming apparatus such as the one referred to in this specification of the present invention in which the image bearing member is cleaned by the developing apparatus 4, those toner particles adhering to the peripheral surface of the photosensitive member 1 must pass the transfer roller 5 and the charge roller 2, which are in contact with the peripheral surface of the photosensitive member 1, before they are recovered by the developing apparatus 4, which creates the following problem.

That is, when a "cleanerless" image forming apparatus is forced to stop while it is forming a substantially solid black image or the like, the peripheral surface of the photosensitive member 1 from the development zone to the transfer roller 5 is covered with the toner particles, the amount of which is 0.5–0.7 mg/cm$^2$. If these toner particles are not transferred and reach the charge roller 2, it becomes difficult to charge the peripheral surface of the photosensitive member 1 to a predetermined potential level by applying a predetermined charge bias to the charge roller 2; the peripheral surface of the photosensitive member 1 is not charged to the predetermined potential level. Consequently, when bias is supplied to the development roller 8 to recover these toner particles by the development roller 8, a predetermined potential level difference is not created between the peripheral surfaces of the photosensitive member 1 and the development roller 8, and therefore, it becomes difficult for these toner particles to be recovered.

Thus, in this embodiment, in order to deal with a situation in which a "cleanerless" image forming apparatus is forced to stop during an actual image forming process, the following steps are taken. During the recovery rotation of the photosensitive member 1, first, the toner particles which have not been transferred and are remaining on the photosensitive member 1 are recovered by keeping the potential level of the charge bias at 0 V, and applying to the development roller 8 such polarity that is suitable for recovering the residual toner particles. Thereafter, the potential level of the charge bias is increased to raise the surface potential level of the photosensitive member 1 to start the normal image forming operation.

FIG. 4 is a graph depicting the bias controlling sequence in this embodiment which is followed during the recovery operation carried out after a "cleanerless" image forming apparatus is forced to stop by a paper jam or the like. According to this sequence, after a foreign object, that is, the cause of the paper jam, is removed by opening the unillustrated cover of the main assembly of the image forming apparatus, the cover is shut again. Then, the peripheral surface of the photosensitive member 1 is uniformly exposed. As a result, the surface potential level of the photosensitive member 1 falls to substantially 0 V. Then, the "post-paper jam" preparatory rotation is started. Immediately before the start of this preparatory rotation, the potential levels of all biases are kept at 0 V as they are in the preceding embodiments of the present invention.

Next, a signal is inputted, and the apparatus starts the preparatory rotation. At this moment, the potential level of the photosensitive member 1, adjacent to the charge roller 2, is still 0 V because voltage has not been applied to the charge roller 2 from the charge bias power source 7.

As the photosensitive member 1 rotates, the toner particles, that is, the constituents of the toner image, which are on the peripheral surface of the photosensitive member 1, between the development zone and the transfer roller 5 before the start of the preparatory rotation, reach the interface between the development roller 8 and the photosensitive member 1. By this time, bias with a potential level of +350 is being applied to the development roller 8 to transfer the toner particles on the photosensitive member 1 to the development roller 8, and therefore, the toner particles with the normal polarity on the photosensitive member 1 are recovered by the development roller 8. In this embodiment, the bias for recovering the toner particles on the photosensitive member 1 by the development roller 8 is continuously applied while the photosensitive member 1 is rotated three full turns in consideration of the ambient condition and the amount of the toner particles on the photosensitive member 1. The period indicated by a character A in FIG. 4 is the time it takes for the peripheral surface of the photosensitive member 1 to move a distance equal to the distance from the charge roller 2 to the development zone, and the period indicated by a character B is the time it takes for the photosensitive member 1 to rotate one full turn.

As soon as the rotation for removing the residual toner particles attributable to a paper jam or the like is completed after a predetermined length of time, charge bias begins to be applied to the charge roller 2 to charge the photosensitive member 1 as it does in the preceding embodiments. This charge bias is linearly increased from a level, the absolute value of which equals the absolute value of the charge start threshold value for the photosensitive member 1, that is, from −600 V in this embodiment, to a level, the absolute value of which equals the sum of the absolute values of the target surface potential level of the photosensitive member 1 and the charge start threshold value for the photosensitive member 1, to linearly increase the surface potential level of the photosensitive member 1 in the direction of negative polarity. More specifically, the voltage output of the charge bias power source 7 is linearly increased until the surface potential level of the photosensitive member 1 reaches −700 V; in other words, it is continuously and linearly increased for a predetermined period of time, that is, until it reaches approximately −1300 V.

Then, as the photosensitive member 1 rotates, the charged portion of the peripheral surface of the photosensitive member 1, that is, the portion charged by the charge roller 2, reaches the development zone. At the very moment when the leading edge of this portion reaches the development zone, the surface potential of the photosensitive member 1 between the charge roller 2 and the development zone is such that the farther from the leading edge, the greater the potential in terms of negative polarity, because the bias applied to the charge roller 2 is being controlled in the manner described above. Further, the bias applied to the development roller 8 during this period is steplessly and continuously increased from +350 V with the same rate as in the preceding embodiments. In other words, the bias applied to the development roller 8 is increased so as to always maintain +350 V between the surface potential of the photosensitive member 1 and the bias applied to the development roller 8.

The sequence described above is continuously repeated until the voltage output of the charge bias power source 7 and the voltage output of the development bias power source 12 reaches −1,300 V and −350 V, respectively, that is, until the image forming apparatus becomes ready for the actual image forming process.

Also in this embodiment pertaining to the sequence for restoring the apparatus to the normal condition after a paper jam or the like, negative voltage begins to be applied to the transfer roller 5 at the beginning of the preparatory rotation of the photosensitive member 1, so that force is generated to return the toner particles or the like adhering to the transfer roller 5, to the photosensitive member 1. Therefore, the toner particles remaining on the photosensitive member 1 do not adhere to the transfer roller 5. In this embodiment, this negative voltage applied to the transfer roller 5 is −1 kV.

Then, after the output of the development bias power source 12 reaches −350 V, weak positive bias begins to be applied immediately before the start of the actual image forming process for a predetermined length of time. The potential level of this weak bias is approximately +1 kV. Then, after the elapsing of a predetermined length of time from the start of the actual image forming process, the bias applied to the transfer roller 5 is changed from this weak positive bias to +2 kV, that is, the normal potential level of the transfer bias to carry out the actual image forming process.

As for the bias applied to the coating roller 9, a voltage much greater in the negative direction on the voltage scale than the voltage applied to the development roller 8 begins to be applied at the beginning of the preparatory rotation. In this embodiment, the potential level of this toner coating bias is −500 V.

As the preparatory rotation sequence described above is completed, that is, as the outputs of the charge bias power source 7 and the development bias power source 12 reach the predetermined voltage levels, respectively, and the preparatory rotation ends, the actual image forming process is started, whereby a toner image is placed on the transfer medium P.

When the sequence in this embodiment described above was carried out after the image forming apparatus was forced to stop by a paper jam or the like during an actual image forming process, desirable copies with no contamination on the back side of the transfer medium P were produced as when the sequence in the first embodiment was carried out.

As is evident from the description given above, in this embodiment which pertains to such a situation that a "cleanerless" image forming apparatus is forced to stop during an actual image forming process, if the image forming apparatus is forced to stop during an actual image forming process, the toner particles remaining on the photosensitive member 1 are recovered by applying the toner recovering bias to the development roller 8. Thereafter, the potential level of the charge bias is increased to raise the surface potential level of the photosensitive member 1 to start an image forming operation. In other words, according to this embodiment, the residual toner particles can be easily recovered, and therefore, the contamination of the transfer roller 5 and charge roller 2 by toner particles, the scattering of toner particles in the internal space of the apparatus, and the like problems can be prevented. Thus, high quality images can be produced for a long period of time.

Although this embodiment of the present invention primarily relates to the bias control sequence carried out after an image forming apparatus is forced to stop during the actual image forming process, it is obvious that this bias control sequence may be employed in combination with one of the bias control sequences in the preceding embodiments, followed during the preparatory rotation of the photosensitive member 1 after the image forming apparatus is left unused or is on standby, for a substantial period of time.

Further, in this embodiment, the potential level of the bias applied to the charge roller 2 is kept at 0 V for a predetermined period of time after the beginning of the preparatory rotation. However, in order to prevent the toner particles from adhering to the charger roller 2, a bias with a potential level higher than 0 V may be applied to the charge roller 2 from the charge bias power source 7 as long as the potential level is within a range of 0—−750 V. The range of 0—−750 V is set in consideration of the fact that the output of the development bias power source is +350 V; the potential level margin relative to the toner particles with the polarity opposite to the normal polarity is 500 V; and the discharge threshold voltage is approximately −600 V. For example, if −750 V is applied to the charge roller 2, the surface potential level of the photosensitive member 1 becomes −150 V after a predetermined length of time from the end of the preparatory rotation, and therefore, the difference between the surface potential level of the photosensitive member 1 and the potential level of the developing bias applied to the development roller 8 does not exceed 500 V.

As described above, according to the present invention, a region in which the electrical field formed between the peripheral surfaces of an image bearing member and a developer carrying member drastically changes is not created, and therefore, the developer particles charged to the polarity opposite to the normal developer particles polarity do not adhere to the image bearing member. As a result, contamination of the transferring means and the charging means by the developer, the scattering of the developer within the internal space of the apparatus, and the like problems are prevented. Thus, high quality images can be reliably outputted.

In the preceding embodiments, the charging means and the transferring means were both constituted of electrodes in the form of a roller, and the developing method was of a reversal development type. However, the electrodes may be in the form of a brush or a blade, and the development method may be of a normal development type. Further, not only is the present invention compatible with the aforementioned nonmagnetic single component developer, but also with two component developer of the conventional type or the magnetic single component toner.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus wherein a developer remaining on a photosensitive member after an image transfer process is removed by developing means, said apparatus comprising:

an electrophotographic photosensitive member;

a contact charging means including an electrode contacted to said photosensitive member to electrically charge said photosensitive member, said contact charging means being supplied with a bias voltage form a charging bias voltage source;

exposure means for exposing said photosensitive member to form an electrostatic latent image thereon after said photosensitive member is electrically charged by said charging means;

developing means for supplying the developer from a developer carrying member to a latent image portion of said photosensitive member to develop said photosensitive member and simultaneously removing the developer remaining on said photosensitive member after the transfer process and conveyed to a downstream of said contact charging means on said photosensitive member, to said developer carrying member by a potential difference between said developer carrying member supplied with a developing bias and a latent image of said photosensitive member; and control means for controlling said charging bias and a developing bias, during a preparatory pre-rotation process of said photosensitive member for preparation for an image forming operation, to maintain a potential difference between said photosensitive member and said developer carrying member at a level lower than that during normal image forming operation, by surface potentials of said developer carrying member supplied with the developing bias and of said photosensitive member charged by said charging means.

2. An apparatus according to claim 1, wherein said control means renders a polarity of a voltage applied by a development bias voltage source immediately after rotation start of said preparatory pre-rotation opposite from that during the image forming operation.

3. An apparatus according to claim 1 or 2, wherein said control means stepwisely changes the developing bias to provide the lower potential difference during the preparatory pre-rotation.

4. An apparatus according to claim 1 or 2, wherein said control means continuously changes the developing bias to provide the low potential difference during the preparatory pre-rotation.

5. An apparatus according to claim 1, wherein said control means controls said charging bias and said developing bias so as to maintain an absolute value of the potential difference between said photosensitive member and said developer carrying member within a range 100–500V during the preparatory pre-rotation.

6. An apparatus according to claim 1, wherein said preparatory pre-rotation is effected before a regular image forming operation is carried out.

7. An apparatus according to claim 1, wherein said preparatory pre-rotation is effected after forced stop of the image forming operation but before resumption of a regular image forming operation.

8. An image forming apparatus wherein a developer remaining on a photosensitive member after an image transfer process is removed by developing means, said apparatus comprising:

an electrophotographic photosensitive member;

a contact charger including an electrode contacted to said photosensitive member to electrically charge said photosensitive member, said contact charging means being supplied with a bias voltage form a charging bias voltage source;

an exposure device for exposing said photosensitive member to form an electrostatic latent image thereon after said photosensitive member is electrically charged by said charger;

a developing device for supplying the developer from a developer carrying member to a latent image portion of said photosensitive member to develop said photosensitive member and simultaneously removing the developer remaining on said photosensitive member after the transfer process and conveyed to a downstream of said contact charger on said photosensitive member, to said developer carrying member by a potential difference between said developer carrying member supplied with a developing bias and a latent image of said photosensitive member; and a control circuit for controlling said charging bias and a developing bias, during a preparatory pre-rotation process of said photosensitive member for preparation for an image forming operation, to maintain a potential difference between said photosensitive member and said developer carrying member at a level lower than that during normal image forming operation, by surface potentials of said developer carrying member supplied with the developing bias and of said photosensitive member charged by said charger.

9. An image forming apparatus wherein a developer remaining on a photosensitive member after an image transfer process is removed by developing means, said apparatus comprising:

an electrophotographic photosensitive member;

a contact charging means including an electrode contacted to said photosensitive member to electrically charge said photosensitive member, said contact charging means being supplied with a bias voltage form a charging bias voltage source;

exposure means for exposing said photosensitive member to form an electrostatic latent image thereon after said photosensitive member is electrically charged by said charging means;

developing means for supplying the developer from a developer carrying member to a latent image portion of said photosensitive member to develop said photosensitive member and simultaneously removing spherical developer particles remaining on said photosensitive member after the transfer process and conveyed to a downstream of said contact charging means on said photosensitive member, to said developer carrying member by a potential difference between said developer carrying member supplied with a developing bias and a latent image of said photosensitive member; and control means for controlling said charging bias and a developing bias, during a preparatory pre-rotation process of said photosensitive member for preparation for an image forming operation, to maintain a potential difference between said photosensitive member and said developer carrying member at a level lower than that during normal image forming operation, by surface potentials of said developer carrying member supplied with the developing bias and of said photosensitive member charged by said charging means.

10. An image forming apparatus wherein a developer remaining on a photosensitive member after an image transfer process is removed by developing means, said apparatus comprising:

an electrophotographic photosensitive member;

a contact charging means including an electrode contacted to said photosensitive member to electrically charge said photosensitive member, said contact charging means being supplied with a bias voltage form a charging bias voltage source;

exposure means for exposing said photosensitive member to form an electrostatic latent image thereon after said photosensitive member is electrically charged by said charging means;

developing means for supplying the developer from a developer carrying member to a latent image portion of said photosensitive member to develop said photosensitive member and simultaneously removing the developer remaining on said photosensitive member after the transfer process and conveyed to a downstream of said contact charging means on said photosensitive member, to said developer carrying member by a potential difference between said developer carrying member supplied with a developing bias and a latent image of said photosensitive member;

control means for controlling said charging bias and a developing bias, during a preparatory pre-rotation process of said photosensitive member for preparation for an image forming operation, to maintain a potential difference between said photosensitive member and said developer carrying member at a level lower than that during normal image forming operation, by surface potentials of said developer carrying member supplied with the developing bias and of said photosensitive member charged by said charging means; and transferring means for transferring the developer from said photosensitive member while contacting to a transfer material.

11. An apparatus according to claim 10, wherein said preparatory pre-rotation is effected after forced stop of the image forming operation but before resumption of a regular image forming operation.

12. An apparatus according to claim 11, wherein said preparatory pre-rotation is effected after forced stop of the image forming operation but before resumption of a regular image forming operation, and during the pre-rotation, the transferring means is supplied with a voltage having the same polarity as a regular polarity of the developer.

* * * * *

UNITED STATES PATENT AND TRADEMARK OFFICE

CERTIFICATE OF CORRECTION

PATENT NO. : 5,970,279

DATED : October 19, 1999

INVENTOR(S): KATSUHIRO SAKAIZAWA, ET AL.

It is certified that error appears in the above-identified patent and that said Letters Patent is hereby corrected as shown below:

COVER ITEM [57] ABSTRACT:

Line 8, "form" should read --from--.

COLUMN 4:

Line 4, "are remain" should read --remain--.

COLUMN 18:

Line 48, "form" should read --from--.

COLUMN 19:

Line 43, "form" should read --from--.

UNITED STATES PATENT AND TRADEMARK OFFICE

CERTIFICATE OF CORRECTION

PATENT NO. : 5,970,279

DATED : October 19, 1999

INVENTOR(S): KATSUHIRO SAKAIZAWA, ET AL.

It is certified that error appears in the above-identified patent and that said Letters Patent is hereby corrected as shown below:

COLUMN 20:

Line 12, "form" should read --from--.
Line 48, "form" should read --from--.

Signed and Sealed this

Nineteenth Day of September, 2000

*Attest:*

Q. TODD DICKINSON

*Attesting Officer*

*Director of Patents and Trademarks*